United States Patent [19]

Fikentscher et al.

[11] 4,135,992

[45] Jan. 23, 1979

[54] ZINC ELECTROPLATING BATH

[75] Inventors: Rolf Fikentscher, Ludwigshafen; Klaus Glaser, Mutterstadt; Guenther Gotsmann, Frankenthal; Werner Streit, Bobenheim, all of Fed. Rep. of Germany

[73] Assignee: BASF Aktiengesellschaft, Rheinland/Pfalz, Fed. Rep. of Germany

[21] Appl. No.: 851,823

[22] Filed: Nov. 16, 1977

[30] Foreign Application Priority Data

Dec. 24, 1976 [DE] Fed. Rep. of Germany ..... 2658934

[51] Int. Cl.[2] ..... C25D 3/22

[52] U.S. Cl. ..... 204/55 R

[58] Field of Search ..... 204/55 R, 55 Y, 43 Z, 204/114, 123

[56] References Cited

U.S. PATENT DOCUMENTS

| | | | |
|---|---|---|---|
| 2,451,426 | 10/1948 | Bair et al. | 204/55 Y |
| 3,393,135 | 7/1968 | Rosenberg | 204/55 Y |
| 3,537,959 | 11/1970 | Korpiun et al. | 204/55 R |
| 3,853,718 | 12/1974 | Creutz | 204/55 R |
| 3,869,358 | 3/1975 | Nobel et al. | 204/55 Y |
| 3,886,054 | 5/1975 | Duchene et al. | 204/55 R |
| 3,993,548 | 11/1976 | Creutz et al. | 204/55 R |

FOREIGN PATENT DOCUMENTS

| | | | |
|---|---|---|---|
| 1915653 | 10/1970 | Fed. Rep. of Germany | 204/55 R |

*Primary Examiner*—G. L. Kaplan

*Attorney, Agent, or Firm*—Keil, Thompson & Shurtleff

[57] ABSTRACT

An aqueous cyanide-free alkaline zinc bath for electroplating metallic surfaces with mirror-bright zinc coatings, which bath contains zinc ions, alkali metal hydroxides and, as the brightener, a polyalkylenepolyamine which is at least partially alkylated, with alkyl of 1 to 3 carbon atoms, at the basic nitrogens.

2 Claims, No Drawings

ZINC ELECTROPLATING BATH

The present invention relates to a new zinc electroplating bath which essentially comprises alkylated polyalkylenepolyamines as brighteners.

In industry, mirror-bright zinc coatings have hitherto been applied from acid or alkaline zinc electrolytes. Alkaline zinc electrolytes above all have contained zinc in the form of cyanide complexes. These latter baths, in particular, have given good results, but their use was no longer advisable because of the toxicity of the effluent, whilst the acid baths, though they gave brighter coatings, had the drawback of being far too corrosive.

The literature reflects the endeavors of those skilled in the art to develop, above all, cyanide-free alkaline baths which do not suffer from the above disadvantages. German Published Application DAS No. 1,496,728 proposes alkaline zinc baths which contain ethylenediaminetetraacetic acid as the complexing agent. German Published Application DAS No. 1,150,255 discloses alkanolamines and/or urotropine as brighteners in alkaline zinc baths. Polyphosphates are proposed for the same purpose in German Laid-Open Application DOS No. 2,312,441.

Finally, DOS No. 2,318,984 describes a combination of heterocyclic nitro compounds (eg. nitroimidazole) and polyethyleneimine as brighteners.

In addition, "Handbuch der Galvanotechnik", Carl-Hanser-Verlag, Volume II, chapter 17.06, page 299, discloses aromatic aldehydes, eg. anisaldehyde, vanillin or piperonal, as brighteners for such baths.

However, in examining these proposals it has been found that bright coatings can only be achieved over a very narrow range of current densities; furthermore, at the high current densities which are necessary if the process is to be rapid, scorching, flaking and the formation of powdery zinc are encountered, and, finally, such scorching and flaking also occurs at elevated temperatures (on annealing). The comtamination of the effluent also remains too high when, for example, ethylenediaminetetraacetic acid is present in the baths.

It is an object of the present invention to provide a cyanide-free alkaline bath which does not suffer from the above disadvantages and permits the production, at high or low current densities, of mirror-bright, ductile zinc coatings which do not flake off even on annealing.

We have found, surprisingly, that this object is achieved with a zinc bath which contains a modified polyalkylenepolyamine.

The aqueous, cyanide-free, alkaline zinc bath for electroplating metallic surfaces with mirror-bright zinc coatings, which contains zinc ions, alkali metal hydroxides, eg. NaOH or KOH, and brighteners based on polyalkylenepolyamines, comprises, as the latter, a polyalkylenepolyamine which is at least partially alkylated with alkyl of 1 to 3 carbon atoms at the basic nitrogens and which corresponds, in the non-alkylated form, to the formula $$H_2N-[(CH_2)_n-NH]_xH$$

where n is from 2 to 4 and x is from 8 to 150 and the $$+CH_2+_n$$

group may be linear or branched, from 0.1 to 2.2 moles of alkylating agent having been employed per equivalent of nitrogen.

The polyalkylenepolyamine which, according to the invention, is present in the zinc bath may be obtained in the conventional manner. Polyethyleneimine, poly-n- or -iso-propyleneimine or polybutyleneimine, preferably polyethyleneimine, conforming to the above definition is reacted in an aqueous, alcoholic or ethereal medium, at from 40° to 130° C., with an alkylating agent (alkyl being of 1 to 3 carbon atoms), preferably in the presence of NaOH, KOH or the corresponding carbonates. Preferably, from 0.1 to 2.2 moles of alkylating agent are employed per equivalent of basic nitrogen. Any conventional alkylating agents may be used provided they introduce alkyl of 1 to 3 carbon atoms; preferred alkylating agents are alkyl halides, eg. methyl or ethyl chloride, bromine or iodide, dialkyl sulfates, eg. dimethyl sulfate or diethyl sulfate, or the system formic acid/formaldehyde. If, as is preferred, the reaction is carried out in the presence of alkalis, as mentioned above, the latter are employed in amounts of from 0.1 to 1 mole per mole of alkylating agent.

Advantageously, the zinc bath according to the invention contains from 2 to 50 g/l of zinc ions.

The content of alkali metal hydroxides is suitably from 30 to 250 g/l.

The amount of polyalkylenepolyamine which may be added lies within wide limits and is advantageously related to the concentration of zinc ions. Usually, concentrations of from 0.1 to 50 g/l, preferably from 0.5 to 5 g/l, are chosen.

The baths according to the invention can also contain one or more other, conventional, brighteners. These are above all aromatic aldehydes, eg. anisaldehyde or vanillin or their bisulfite adducts, or ketones, eg. benzalacetone, heterocyclic nitro compounds, eg. nitroimidazole, betaines, eg. benzylpyridinium carboxylate, or other imidazole derivatives, eg. the reaction product of ethylimidazole and epichlorohydrin; such conventional brighteners may also be found in the above literature. If they are present - as is advantageous in various circumstances because of their synergistic effect, their amount is advantageously from 0.1 to 10, preferably from 1 to 5, g/l.

Zinc electroplating using the baths according to the invention is as simple as with conventional baths. For example, the article to be zinc-plated is introduced into the bath containing the above constituents and is wired as the cathode. The duration of the process depends on the desired thickness of the zinc coating and on the current density employed. In general, the latter is from 0.3 to 20 A/dm$^2$, the bath temperature is from 20 to 50° C., and the process requires from 1 to 30 minutes.

The baths according to the invention, for producing bright zinc coatings, provide a dramatic technical advance in respect of the brightness and ductility of the coatings obtained. Whilst alkaline zinc-plating processes have conventionally only given silvery-white but relatively matt coatings (as typified by the appearance of a zinc-plated screw) it is now possible, even by adding only very small amounts of alkylated polyalkylenepolyamines, to obtain, over a very wide range of current densities, such as are bound to occur when zinc-plating sizable articles, mirror-bright zinc coatings which have hitherto only been achievable with acid zinc baths - though not as effectively - and which in respect of brilliance and mirror finish resemble a nickel or chromium coating. In addition to its ductility, the zinc coating has unusual chemical stability and heat stability and can be annealed without damage such as flaking or melting.

The Examples which follow illustrate the invention without implying a limitation.

EXAMPLE 1

To prepare the polyalkylenepolyamine reaction product, 705 g (8.2 mole equivalents of N) of a 50% strength aqueous solution of a polyethyleneimine of molecular weight from 600 to 5,000 are used as the starting material, and 413 g (3.28 moles) of dimethyl sulfate are added in the course of 40 minutes, whilst cooling with ice. The mixture is then stirred for 2 hours at 50° C, after which 87.2 g (1.06 moles) of concentrated sodium hydroxide solution are added cautiously. The reaction has ended after stirring for one hour at 80° C.

An aqueous electrolyte comprising 9 g/l of Zno, 80 g/l of NaOH, 0.9 g/l of 1 -benzylpyridinium-3-carboxylate and 2.6 g/l of the above alkylated polyethyleneimine is subjected to a Hull cell test (German Standard Specification DIN No. 50,957, 250 ml) for 10 minutes at a bath temperature of 25° C. The cell current is 1 A. The test sheet which, for greater ease of examination of the coatings, consists of brass which is more readily distinguishable from the colorless zinc, is introduced into the bath at an angle, ie. one end of the sheet is at a greater distance (corresponding to a low current density) from the anode than is the other end (corresponding to a high current density). To remove discolorations, the test sheet is subsequently dipped into 0.5% strength nitric acid.

A mirror-bright ductile zinc coating extending from the lowest to the highest current density zone is obtained.

EXAMPLE 2

The experiment described in Example 1 is repeated with the modification that 0.4 g/l of anisaldehyde-bisulfate is added to the bath and that the coating time is extended to 30 minutes.

A zinc coating of even deeper brillance is obtained.

To demonstrate the good adhesion, the sheet is then annealed for two hours at 170° C, after which it is deformed mechanically.

The coating did not flake off, was not discolored and showed no signs of melting.

COMPARATIVE EXAMPLE

A commercial polyethyleneimine of mean molecular weight 1,200 is employed as the polymer in parallel with Example 2. The electrolyte accordingly comprises: 9 g/l of ZnO, 80 g/l of NaOH, 0.9 g/l of 1-benzylpyridinium-3-carboxylate, 0.4 g/l of anisaldehydebisulfite and 1.6 g/l of polyethyleneimine of molecular weight 1,200.

The procedure followed is as described in Example 2 and the coating time is again extended to 30 minutes.

A bright coating with slight scorching in the high current density zone is obtained.

The sheet is then annealed as in Example 2. The coating is found to flake in the medium and high current density zones and exhibits grey to black discolorations.

EXAMPLE 3

An aqueous electrolyte comprising 62 g/l of $ZnSO_4$, 140 g/l of NaOH, 30 g/l of $Na_2CO_3$, 1.5 g/l of an alkylated polyethyleneimine as described in Example 1, 5 g/l of an imidazole reaction product and 0.05 g/l of piperonal is subjected to the Hull cell test under the same conditions as those described in Example 1.

After 10 minutes, mirror-bright and ductile zinc coatings are obtained, which can be treated satisfactorily in a commercial chromate electrolyte.

To prepare the imidazole reaction product employed, 17.3 g (0.18 mole) of ethylimidazole are mixed with 70 g of water and reacted with 30.5 g (0.33 mole) of epichlorohydrin in a threenecked flask, whilst cooling.

EXAMPLE 4

To prepare an alkylated polyethyleneimine, 200 g (2.33 mole equivalents of nitrogen) of a 50% strength aqueous polyethyleneimine solution of mean molecular weight from 600 to 5,000 are used as the starting material and 152 g (1.4 moles) of ethyl bromide are added slowly, whilst stirring. The temperature should not exceed 40° C. When all ethyl bromide has been added, the reaction is allowed to continue for 3.5 hours at 45° C.

3.5 g/l of the above substance are added to the following aqueous electrolyte: 21 g/l of $ZnCl_2$, 115 g/l of NaOH, 35 g/l of $Na_2CO_3$, 1.1 g/l of 1-benzylpyridinium-3-carboxylate and 0.3 g/l of a nisaldehyde-bisulfite.

After 10 minutes, mirror-bright, non-hazy and ductile coatings are obtained in a Hull cell test in accordance with German Standard Specification DIN No. 50,957 (compare Example 1).

We claim:

1. An aqueous cyanide-free alkaline zinc bath for electroplating metallic surfaces with mirror-bright zinc coatings, which bath contains from 2 to 50 g/l of zinc ions, from 30 to 250 g/l of an alkali metal hydroxide and from 0.1 to 50 g/l of a polyalkylene-polyamine of the formula $$H_2N-[(CH_2)_n-NH]_xH$$

where n is from 2 to 4 and x is from 8 to 150 and the $-(CH_2)_n-$ group may be linear or branched, the said polyalkylenepolyamine being alkylated at the basic nitrogens with from 0.1 to 2.2. moles per equivalent of nitrogen of an alkylating agent selected from the group consisting of methyl chloride, ethyl chloride, methyl bromide, ethyl bromide, methyl iodide, ethyl iodide, dimethyl sulfate and diethyl sulfate.

2. A zinc bath as set forth in claim 1, in which the alkali metal hydroxide is NaOH or KOH.

* * * * *